US006507720B2

(12) United States Patent
Kabumoto et al.

(10) Patent No.: US 6,507,720 B2
(45) Date of Patent: Jan. 14, 2003

(54) COLOR IMAGE FORMING APPARATUS AND TONER REPLENISHING APPARATUS EACH INCLUDING PLURAL TONER CONTAINERS RECEIVED IN RECEIVING MEMBER OF SETTING PART AND TONER CONTAINERS THEREFOR

(75) Inventors: Masaaki Kabumoto, Yachio (JP); Goro Katsuyama, Yokohama (JP); Kanae Amemiya, Tokyo (JP); Masahiro Kurita, Yokohama (JP); Masahiro Yonekawa, Machida (JP); Tomotoshi Nakahara, Kawasaki (JP); Masumi Sato, Yokohama (JP); Takaaki Yanagisawa, Tokyo (JP); Yoshio Hattori, Kawasaki (JP); Kouta Fujimori, Yokohama (JP); Satoshi Muramatsu, Yokohama (JP); Junichi Matsumoto, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/910,080

(22) Filed: Jul. 23, 2001

(65) Prior Publication Data

US 2002/0009310 A1 Jan. 24, 2002

(30) Foreign Application Priority Data

| | | |
|---|---|---|
| Jul. 21, 2000 | (JP) | 2000-220871 |
| Jul. 21, 2000 | (JP) | 2000-220872 |
| May 11, 2001 | (JP) | 2001-141631 |

(51) Int. Cl.[7] ..... G03G 15/08
(52) U.S. Cl. ..... 399/258; 399/262
(58) Field of Search ..... 399/119, 120, 399/223, 258, 260, 262

(56) References Cited

U.S. PATENT DOCUMENTS

| | | | | |
|---|---|---|---|---|
| 4,835,582 A | | 5/1989 | Kasahara et al. | |
| 4,908,661 A | | 3/1990 | Iwata et al. | |
| 5,008,711 A | | 4/1991 | Sakamoto et al. | |
| 5,162,859 A | | 11/1992 | Hirono et al. | |
| 5,245,385 A | | 9/1993 | Fukumizu et al. | |
| 5,289,147 A | | 2/1994 | Koike et al. | |
| 5,325,162 A | * | 6/1994 | Kroll et al. | 399/262 X |
| 5,339,141 A | | 8/1994 | Suzuki et al. | |
| 5,367,363 A | | 11/1994 | Kai et al. | |
| 5,386,274 A | | 1/1995 | Sanpe | |
| 5,392,102 A | * | 2/1995 | Toyoizumi et al. | 399/262 X |
| 5,400,123 A | | 3/1995 | Sato et al. | |
| 5,424,814 A | | 6/1995 | Suzuki et al. | |
| 5,440,373 A | | 8/1995 | Deki et al. | |
| 5,512,984 A | | 4/1996 | Kimura et al. | |

(List continued on next page.)

FOREIGN PATENT DOCUMENTS

| | | |
|---|---|---|
| EP | 1 014 214 | 6/2000 |
| JP | 8-211715 | 8/1996 |
| JP | 9-80842 | 3/1997 |

OTHER PUBLICATIONS

Patent Abstracts of Japan, JP 03–072381, Mar. 27, 1991.
Patent Abstracts of Japan, JP 09–050174, Feb. 18, 1997.

*Primary Examiner*—William J. Royer
(74) *Attorney, Agent, or Firm*—Oblon, Spivak, McClelland, Maier & Neustadt, P.C.

(57) ABSTRACT

A color image forming apparatus includes a main body and a toner container setting part configured to set a plurality of toner containers individually therein. Each toner container contains a toner of a different color, and the setting part includes a receiving member configured to receive the plurality of toner containers inserted therein. The plurality of toner containers, inserted in the receiving member, are partially exposed.

34 Claims, 7 Drawing Sheets

U.S. PATENT DOCUMENTS 5,515,145 A 5/1996 Sasaki et al.
5,537,197 A 7/1996 Fujishiro et al.
5,565,973 A 10/1996 Fujishiro et al.
5,583,630 A 12/1996 Kimura et al.
5,630,195 A 5/1997 Sawayama et al.
5,648,842 A 7/1997 Sekine et al.
5,655,193 A 8/1997 Fujishiro et al.
5,663,788 A 9/1997 Sanpe
5,671,465 A 9/1997 Kimura et al.
5,761,570 A 6/1998 Sawayama et al.
5,860,038 A 1/1999 Kato et al.
5,875,380 A 2/1999 Iwata et al.
RE36,301 E 9/1999 Kai et al.
5,953,567 A 9/1999 Muramatsu et al.
5,953,568 A 9/1999 Fujishiro et al.
5,962,783 A 10/1999 Iwata et al.
5,987,298 A 11/1999 Muramatsu et al.
6,055,386 A 4/2000 Kato et al.
6,057,936 A 5/2000 Obara et al.
6,070,030 A 5/2000 Fujishiro
6,112,046 A 8/2000 Suzuki et al.
6,125,257 A 9/2000 Sekine et al.
6,128,459 A 10/2000 Iwata et al.
6,142,690 A 11/2000 Yoshimura et al.
6,160,569 A 12/2000 Fujimori et al.
6,163,669 A 12/2000 Aoki et al.
6,201,941 B1 3/2001 Kasahara et al.
6,215,974 B1 * 4/2001 Katoh et al. ..... 399/258
6,226,475 B1 5/2001 Kabumoto et al.
6,259,866 B1 7/2001 Kabumoto et al.
6,282,396 B1 8/2001 Iwata et al.
6,295,437 B1 9/2001 Hodoshima et al.
6,295,438 B1 9/2001 Fujishiro et al.
6,304,739 B1 10/2001 Katsuyama et al.
6,308,027 B1 10/2001 Obu et al.
6,381,435 B2 4/2002 Shinohara et al.
6,393,241 B1 5/2002 Matsumoto et al.

* cited by examiner

COLOR IMAGE FORMING APPARATUS AND TONER REPLENISHING APPARATUS EACH INCLUDING PLURAL TONER CONTAINERS RECEIVED IN RECEIVING MEMBER OF SETTING PART AND TONER CONTAINERS THEREFOR

CROSS-REFERENCE TO RELATED APPLICATIONS

This application is related to and claims priority, under 35 U.S.C. § 119, from Japanese Patent Application No. 2000-220871, filed on Jul. 21, 2000, Japanese Patent Application No. 2000-220872, filed on Jul. 21, 2000, and Japanese Patent Application No. 2001-141631, filed on May 11, 2001, the entire contents of the three above-listed Japanese Patent Applications are hereby incorporated by reference herein.

BACKGROUND OF THE INVENTION

1. Field of the Invention

The present invention relates to a color image forming apparatus, a toner replenishing device, and a toner container therefor.

2. Discussion of Background

At least four methods of forming a color image with a color image forming apparatus are known, including: a transfer drum method; an intermediate transfer method; an image-on-image method; and a tandem method.

In the transfer drum method, a transfer sheet is wound around a transfer drum. The transfer drum is most preferably made of a dielectric film. The transfer sheet is located so as to be opposed to a photoconductor. Electrophotographic processes, of forming a latent image, developing the latent image, and transferring the developed image to the transfer sheet, are repeated for each color of yellow (Y), magenta (M), cyan (C) and black (Bk). Thereby, a toner image of each color is sequentially formed on the transfer sheet so that the different color toner images are superimposed upon each other in order for a full color image to be obtained.

In the intermediate transfer method, instead of transferring a toner image of each color onto a transfer sheet which is wound around a transfer drum, the toner image of each color is sequentially transferred onto a drum or belt, called an intermediate transfer member, and the different color toner images are superimposed upon each other so that a full color toner image is obtained on the intermediate transfer member. The full color toner image is then transferred onto a transfer sheet.

In the image-on-image method, the electrophotographic processes, of forming a latent image, developing the latent image, and transferring the developed image onto a transfer sheet, are performed for each color of yellow (Y), magenta (M), cyan (C) and black (Bk) on a photoconductor and thereby, a full color toner image is obtained on the transfer sheet.

In the tandem method, a toner image formed by an image forming unit is sequentially transferred onto a transfer sheet conveyed by a transfer belt, and different color toner images are superimposed upon one another so that a full color image is obtained on the transfer sheet.

An image forming apparatus using any of the above-described methods includes a developing device for each of three or four colors (i.e., yellow, magenta, cyan, and black). Further, near each developing device, all of a toner storage unit, e.g., a toner bottle, a toner cartridge, a toner tank, etc., are provided to supply toner to the developing device. It is desired that the toner storage unit store more black toner, which is the most frequently used color, than toners of other colors, and many storage units recently appearing on the market are configured to store more black toner than toner of other colors.

However, in the above-described image forming apparatus, it is hard to obtain a space to arrange a toner storage unit, e.g., four toner bottles, near the developing device. Further, because each of the toner bottles must be replaced by the user, it is desirable that each toner bottle can be easily replaced from the front side of the apparatus. As a result, despite the fact that the black toner is consumed more than toners of other colors, it is difficult to store a large amount of black toner without making the apparatus unduly large.

SUMMARY OF THE INVENTION

The present invention has been made in view of the above-discussed and other problems and addresses the above-discussed and other problems.

Preferred embodiments of the present invention provide a novel color image forming apparatus in which replacement of a toner container is simple, without unduly increasing the size of the apparatus, and the preferred embodiments of the present invention also provide a toner container for the color image forming apparatus.

According to a preferred embodiment of the present invention, a color image forming apparatus includes a main body and a toner container setting part configured to set a plurality of toner containers individually therein. Each toner container contains toner of a different color, and the setting part includes a receiving member configured to receive the plurality of toner containers inserted therein. The plurality of toner containers inserted in the receiving member are partially exposed.

The receiving member may be opened at an upper part thereof, so that the plurality of toner containers can be inserted into and drawn out of the receiving member from above. In this case, upper parts of the plurality of toner containers, inserted in the receiving member, are exposed.

The plurality of toner containers, set in the setting part, may be arranged parallel to each other in a straight line.

The color image forming apparatus may include a transfer belt, to convey a transfer sheet, and a plurality of image forming units arranged along the transfer belt. In this case, the plurality of toner containers, set in the setting part, are arranged in a direction orthogonal to a moving direction of the transfer belt. Further, the moving direction of the transfer belt may be in a width-wise direction of the main body, and the plurality of toner containers, set in the setting part, may be arranged in the depth-wise direction of the main body. The plurality of toner containers, set in the setting part, may be arranged at an upper part of the main body substantially along an edge of the main body.

In the above-described color image forming apparatus, the receiving member may differ in length, in a direction along which the plurality of toner containers are inserted therein, according to a length of a corresponding toner container of the plurality of toner containers.

Further, in the above-described color image forming apparatus, upper surfaces of the plurality of toner containers, inserted into the receiving member, may be substantially at a uniform level.

Furthermore, in the above-described color image forming apparatus, a toner container of the plurality of toner containers, which has either a largest toner containing capacity or a longest length, in a direction along which the plurality of containers are inserted into the receiving member, may be set at a front side of the apparatus in the setting part in a depth-wise direction of the main body.

Still furthermore, in the above-described color image forming apparatus, a toner container of the plurality of toner containers, which is either most frequently replaced or which contains black toner, may be set at a front side of the apparatus in the setting part in a depth-wise direction of the main body.

Further, in the above-described color image forming apparatus, the transfer belt may be slanted so that a first end thereof is lower than a second opposing end thereof, and the setting part may be provided above the first, lower end of the transfer belt. In this case, the toner container of the plurality of toner containers, which is set at a front side of the apparatus in the setting part in the depth-wise direction of the main body, may be located outside of an area in the width-wise direction of the main body, where the transfer belt is located. Further, the plurality of toner containers may be arranged in the setting part of the apparatus in an order not corresponding to an order of the plurality of image forming units arranged along the transfer belt.

Furthermore, the above-described color image forming apparatus may include a cover configured to cover partially exposed portions of the plurality of toner containers inserted in the receiving member. The cover may be provided for the main body and may be configured to open and close.

According to another preferred embodiment of the present invention, a set of toner containers, to be set in a setting part of a color image forming apparatus, are provided. The set of toner containers are adapted to be set in the setting part of the apparatus, which is configured to fit a plurality of toner containers, individually, and which includes a receiving member configured to receive the plurality of toner containers inserted therein so that the plurality of toner containers inserted into the receiving member are partially exposed. Each of the toner containers includes a deformable toner bag to contain toner, and a case to accommodate the deformable toner bag. The case of a toner container of the plurality of toner containers, which is set at a front side of the apparatus in the setting part in a depth-wise direction, is longer than those of other toner containers of the plurality of toner containers in a direction along which the plurality of toner containers are inserted into the setting part of the color image forming apparatus.

Further, the width of the case of the container of the plurality of toner containers, which is set at the front side of the apparatus in the setting part in the depth-wise direction, is larger than the width of the other toner containers of the plurality of toner containers.

According to another preferred embodiment of the present invention, a toner replenishing apparatus, to replenish a developing device with toner in a color image forming apparatus, includes a setting part configured to set a plurality of toner containers, each containing toner of a different color, individually therein, and a toner conveying device, to convey the toner contained in each of the plurality of toner containers, set in the setting part, to the developing device. The setting part includes a receiving member configured to receive the plurality of toner containers, inserted therein, and the plurality of toner containers inserted into the receiving member, are partially exposed.

The receiving member may be opened at an upper part thereof, so that the plurality of toner containers can be inserted into and drawn out of the receiving member from above. In this case, upper parts of the plurality of toner containers, inserted in the receiving member, are exposed.

The plurality of toner containers set in the setting part may be arranged parallel to each other in a straight line.

When the color image forming apparatus includes a transfer belt to convey a transfer sheet and a plurality of image forming units arranged along the transfer belt, the plurality of toner containers, set in the setting part, are arranged in a direction orthogonal to a moving direction of the transfer belt. When the moving direction of the transfer belt is in a width-wise direction of the image forming apparatus, the plurality of toner containers, set in the setting part, may be arranged in the depth-wise direction of the image forming apparatus. The plurality of toner containers, set in the setting part, may be arranged at an upper part of the image forming apparatus, substantially along an edge of the image forming apparatus.

In the above-described toner replenishing apparatus, the receiving member may differ in length, in a direction in which the plurality of toner containers are inserted therein, according to a length of a corresponding toner container of the plurality of toner containers.

Further, in the above-described toner replenishing apparatus, upper surfaces of the plurality of toner containers, inserted into the receiving member, may be substantially at a uniform level.

Furthermore, in the above-described toner replenishing apparatus, a toner container of the plurality of toner containers, which has either a largest toner containing capacity or a longest length, in a direction in which the plurality of containers are inserted into the receiving member, may be set at a front side of the apparatus in the setting part in a depth-wise direction.

Still furthermore, in the above-described toner replenishing apparatus, a toner container of the plurality of toner containers, either which is most frequently replaced or which contains black toner, may be set at a front side of the apparatus in the setting part in a depth-wise direction.

Further, in the above-described toner replenishing apparatus, when the transfer belt is slanted so that a first end thereof is lower than a second end thereof, the setting part may be provided above the first, lower end of the transfer belt. In this case, the toner container of the plurality of toner containers, which is set at a front side of the apparatus in the setting part in the depth-wise direction, may be located outside of an area in the width-wise direction of the image forming apparatus and at an area where the transfer belt is located. Further, the plurality of toner containers may be arranged in the setting part in an order not corresponding to an order of the plurality of image forming units arranged along the transfer belt.

Furthermore, the above-described toner replenishing apparatus may include a cover configured to cover partially exposed portions of the plurality of toner containers inserted in the receiving member. The cover may be provided for the image forming apparatus and may be configured to open and close.

BRIEF DESCRIPTION OF THE DRAWING FIGURES

A more complete appreciation of the present invention, and many of the attendant advantages thereof, will be readily obtained as the same becomes better understood by reference to the following detailed description, when considered in conjunction with the accompanying drawings, wherein.

DETAILED DESCRIPTION OF THE PREFERRED EMBODIMENTS

Figure 1:
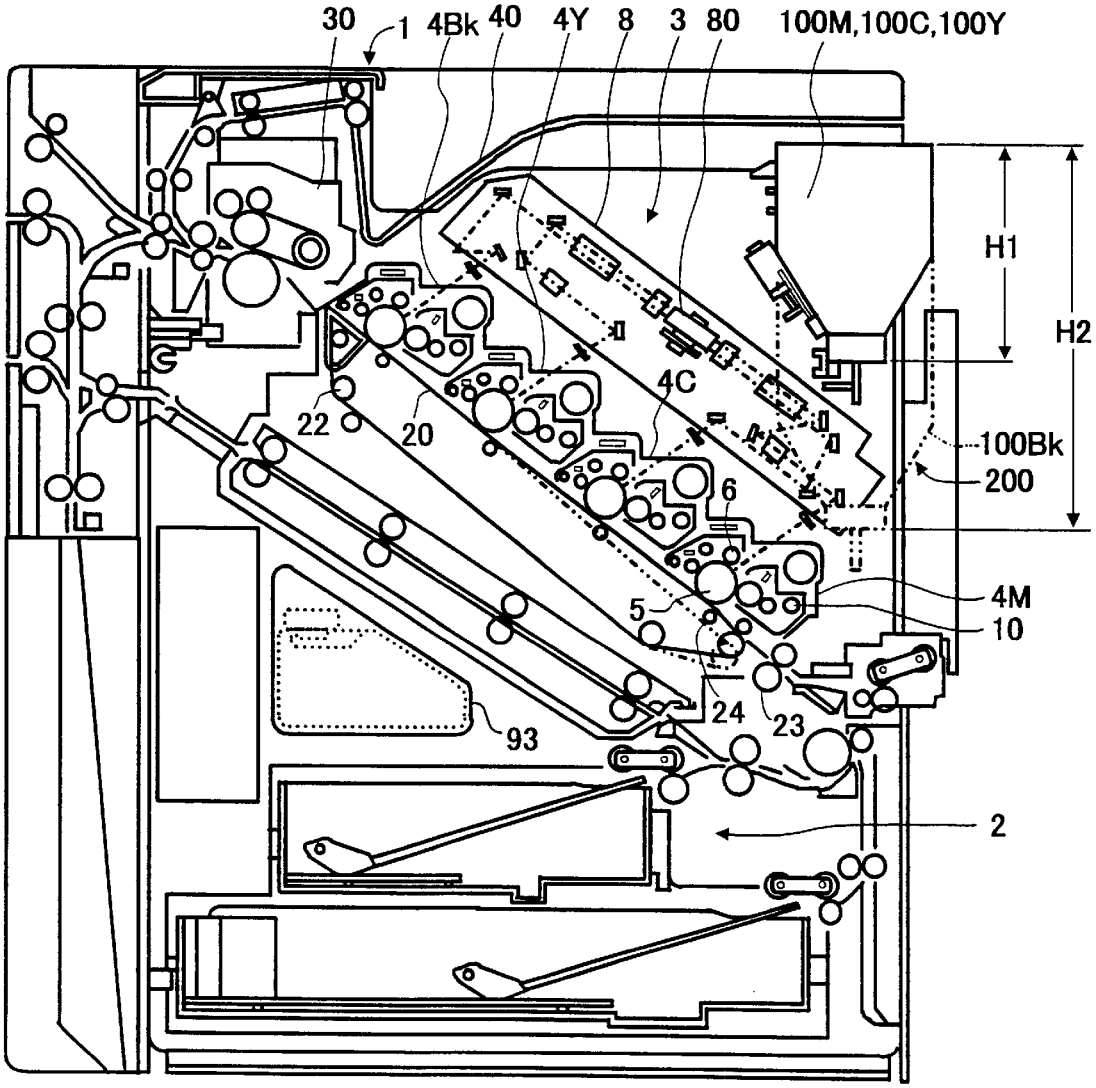
FIG. 1 is a schematic cross-sectional view illustrating a color laser printer as an example of a color image forming apparatus, according to a preferred embodiment of the present invention.

Referring to the drawing figures, like reference numerals designate identical or corresponding parts throughout the several views, and preferred embodiments of the present invention will now be described.

FIG. 1 is a schematic cross-sectional view illustrating a color laser printer, as an example of an image forming apparatus, according to a preferred embodiment of the present invention. The color laser printer has a configuration such that a sheet feeding part 2 is disposed at a lower part of a main body 1 of the apparatus, and an image forming part 3 is disposed above the sheet feeding part 2. The image forming part 3 is provided with a transferring belt apparatus, which is disposed slantingly so that its sheet feeding part side is lower than its sheet discharging part side. The transferring belt apparatus has an endless transferring belt 20 wound over a plurality (i.e., four in this embodiment) of belt wheels 22. Four image forming units 4M, 4C, 4Y, and 4Bk corresponding to magenta (M), cyan (C), yellow (Y), and black (Bk) colors, respectively, are disposed in parallel, from the bottom in the listed order, on an upper traveling side of the transferring belt 20.

As illustrated in FIG. 1, the image forming units 4M, 4C, 4Y, and 4Bk are each provided with a photosensitive drum 5 acting as an image bearer. The photosensitive drum 5 is driven in clockwise rotation by a driving device (not shown). All of a charging roller 6, acting as a charging device, a developing apparatus 10, acting as a developing device, and a cleaning apparatus, acting as a cleaning device, are disposed around the photosensitive drum 5. Optical writing is carried out on a surface of the photosensitive drum 5 using a laser light of an optical writing apparatus 8. The developing apparatus 10 is a two-component developing apparatus using a two-component developer comprising a toner and a carrier. The developing apparatus 10 is replenished with toner from a toner replenishing apparatus, to be described in more detail below, as the toner in the developing apparatus 10 is consumed.

The operation of forming a full color image with the color printer, illustrated in FIG. 1, will now be described with reference to the magenta-color image forming unit 4M.

An optical image, to be developed by a magenta toner, is written by the optical writing apparatus 8 on the photosensitive drum 5. The photosensitive drum 5 is charged by the charging roller 6 by driving a laser diode or LD (not shown) to thereby apply a laser light to a polygon mirror 80 in order to guide a reflected light, via a cylinder lens, etc., onto the photosensitive drum 5. The above-described writing operation forms an electrostatic latent image on the photosensitive drum 5 based on image data sent from a host machine, such as a personal computer, and then the latent image is developed into a visual image of the magenta toner by the developing apparatus 10. The optical writing apparatus 8 is configured so that a reflected light, from the polygon mirror 80, is written on the photosensitive drum 5. In such a configuration, by slantingly arranging the optical writing apparatus 8 so as to be substantially parallel to the transferring belt 20, the optical path length, from the optical writing apparatus 8 to each photosensitive drum 5, can be easily made constant.

At the same time, a sheet or transferring material is fed from the sheet feeding part 2 to abut a registration roller 23, which is disposed on the upstream side in the conveying direction of the transferring belt 20. Then, the sheet is fed onto the transferring belt 20 in synchronization with the above-mentioned visual image. As the transferring belt 20 travels, the sheet is guided to a transferring position opposing the photosensitive drum 5. At this transferring position, the magenta toner visual image is transferred to the sheet by a transferring roller 24 disposed on the back side of the transferring belt 20.

The above-mentioned image forming operation is likewise carried out for each of the other image forming units 4C, 4Y, and 4Bk, thus forming visual images by use of toner of the other colors on their respective photosensitive drums 5. The visual images are then transferred one upon another each time the sheet is conveyed to each transferring position by the transferring belt 20. Thus, the color printer can form a full color image on a sheet in almost the same short time as required for a monochrome image. After transferring, the sheet is released from the transferring belt 20 and undergoes fixing at a fixing apparatus 30. After being fixed, the sheet is then discharged. The sheet is typically reversed and is then discharged into a sheet discharging tray 40 provided on the upper face of the apparatus main body 1. This reverse discharging function is almost an indispensable condition for the printer to arrange prints in a page order.

Figure 2:
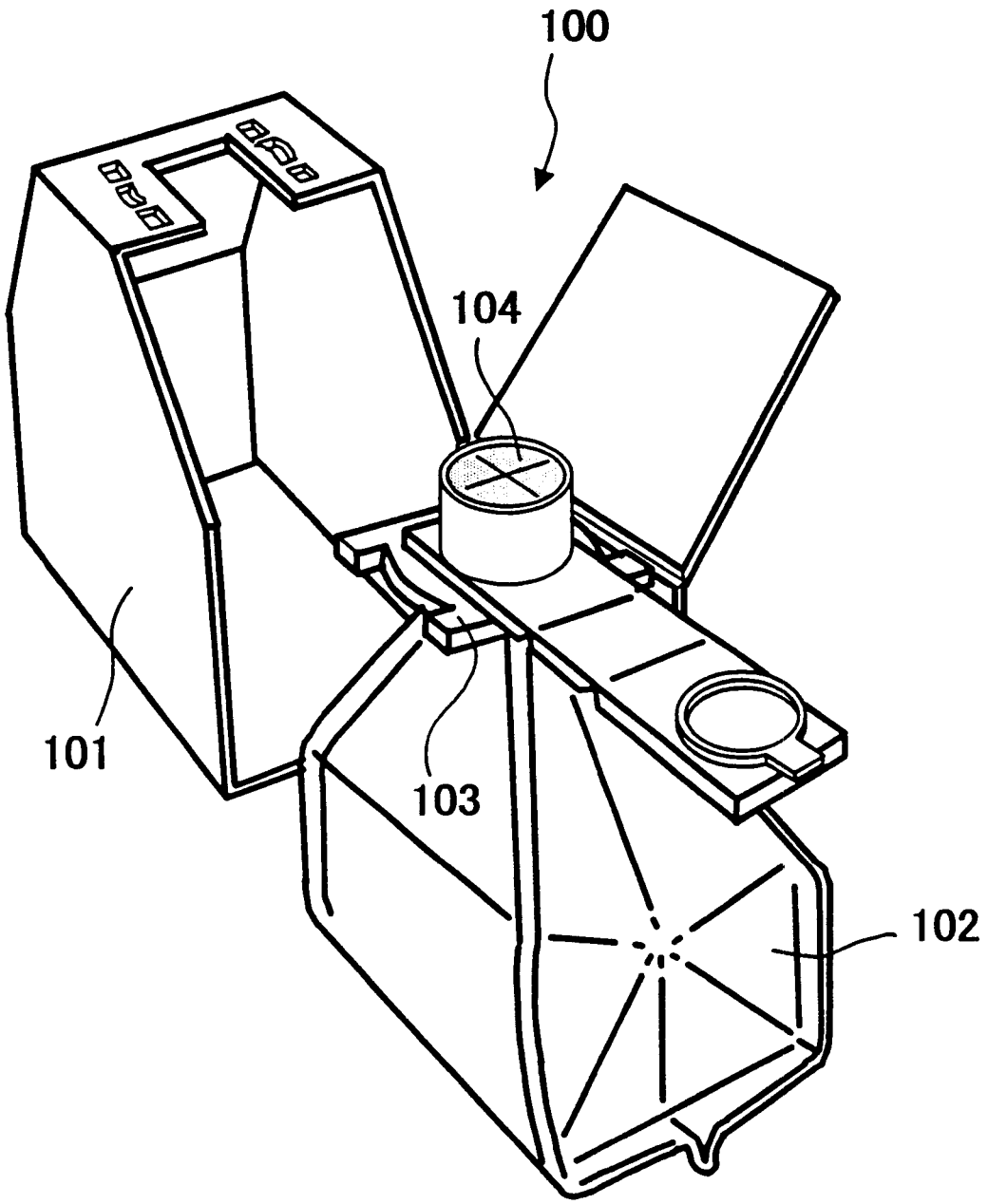
FIG. 2 is a perspective view illustrating an exemplary toner container for the color image forming apparatus of FIG. 1.

As shown in FIG. 2, a toner container 100, containing a toner to be replenished to the developing apparatus 10 of each image forming unit 4M, 4C, 4Y, and 4Bk, is constituted in a bag-in-box type configuration including a toner containing bag 102, which is deformable (hereinafter referred to as "a toner bag"), and an outer case 101, which houses the toner bag 102 therein. The outer case 101 has rigidity higher than that of the toner bag 102. The toner bag 102 is formed of a single layer or a plurality of layers of a flexible sheet, made of paper or a resin, such as polyethylene or nylon, to a thickness of, e.g., 80–200 $\mu$m or so. A base plate 103, which is made of, for example, resin or other similar material, and is formed by a blowing injection molding operation or other similar operation, is fixed to the toner bag 102. A toner supplying part is provided to the base plate 103. The toner bag 102 has a closed configuration and a self-closing valve 104. The self-closing valve 104 is, for example, a seal valve, which is made of, for example, an elastic member or more preferably, a foaming sponge, and the self-closing valve 104 is provided on the base plate 103. The self-closing valve 104 may be constructed by a mechanical shutter which closes by a spring force. The outer or inner surface of the toner bag 102 may be processed with aluminum evaporation for coping with static electricity or humidity.

The outer case 101 has an internal space large enough to accommodate the toner bag 102. The outer case 102 is made of resin or paper, which has appropriate rigidity. Accordingly, although the toner bag 102 has flexibility, because the outer case 101 has appropriate rigidity, the toner container 100 is easy to handle and is convenient for storage.

Figure 3:
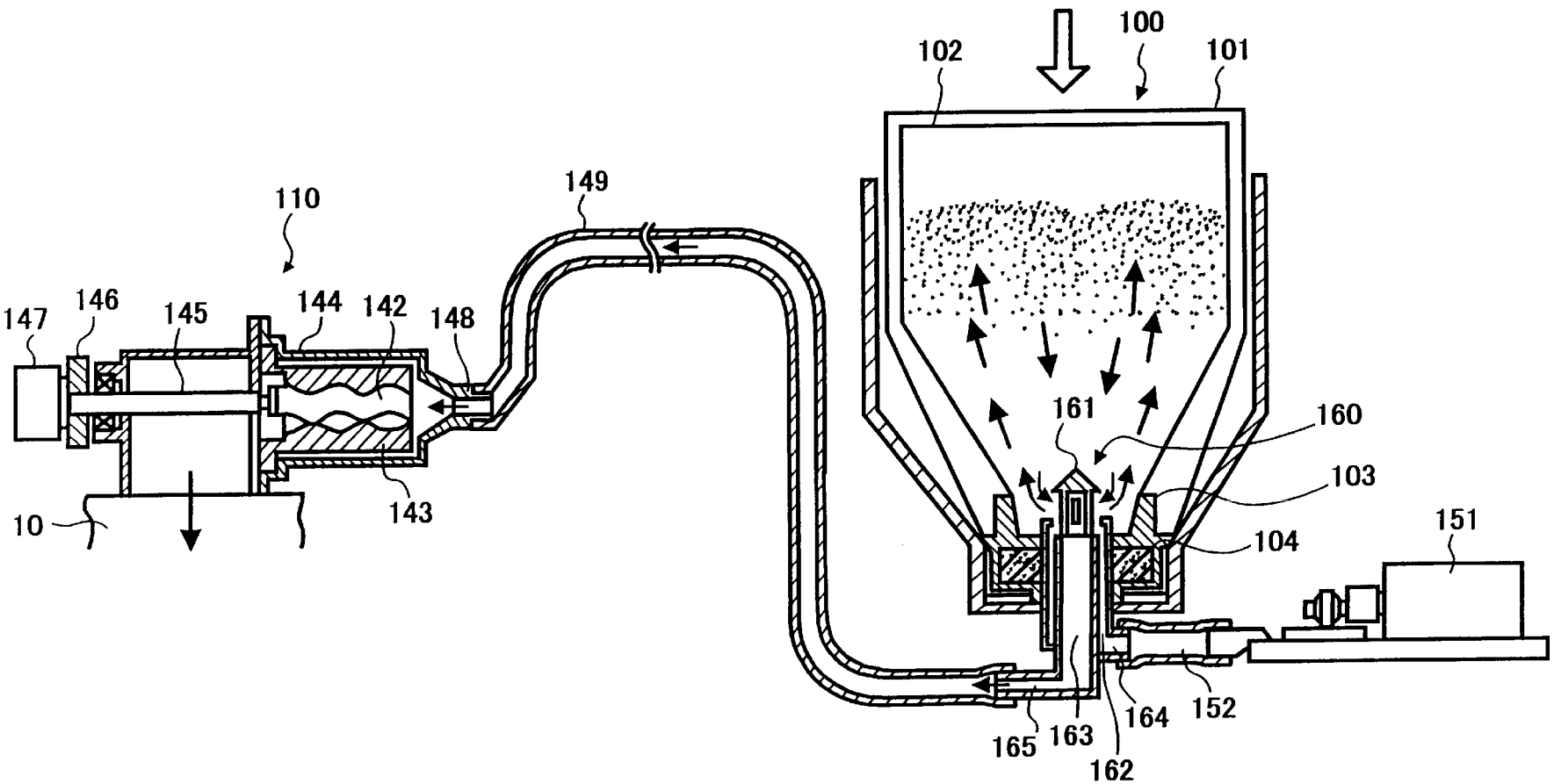
FIG. 3 is a cross-sectional view of an exemplary toner replenishing apparatus of the color image forming apparatus of FIG. 1.

Referring to FIG. 3, a toner replenishing apparatus, which replenishes each of the image forming units 4M, 4C, 4Y, and 4Bk with the toner contained in toner containers 100M, 100C, 100Y, and 100Bk, respectively, will be described.

The developing apparatus 10, of FIG. 3, is provided with a suction type powder pump 110, which is a single-shaft eccentric screw pump, in its vicinity or integrated therewith. As illustrated in FIG. 3, the powder pump 110 includes: a rotor 142, made of a rigid material, such as metal, and formed in an eccentric screw shape; a stator 143, made of an elastic material, such as rubber, and formed in a double-threaded screw shape; and a holder 144 made of a resin material, which encloses the rotor 142 and the stator 143 and which forms a conveying path for a powder. The above-mentioned rotor 142 is driven in rotation by a driving device (not shown) via a gear 146, which is integrally linked to a drive shaft 145 linked with a pin joint of the rotor 142. A reference numeral 147 here indicates an electromagnetic clutch, which controls the operation of the powder pump 110.

Furthermore, the above-mentioned holder 144 is provided with a toner inlet 148 at a tip thereof. The toner inlet 148 is connected via a toner delivering tube 149 to a toner connecting mouth 165 provided on a nozzle 160 (to be described in more detail below). Preferably, the toner delivering tube 149 may be formed in a flexible tube having a diameter of, for example, approximately 4–10 mm. Further, the toner delivering tube 149 is preferably made of a rubber material, for example, polyurethane, nitrile, EPDM, silicon or similar material, which is excellent in toner resistance. The flexible tube can be piped in any desired direction.

With respect to the toner replenishing apparatus described above, it is known that the single-shaft eccentric screw pump, which is the powder pump 110, is capable of continuous constant-quantity delivery of powder at a high solid-gas ratio, so that an accurate quantity of a toner can be delivered proportional to the number of revolutions of the rotor 142. Accordingly, when a toner replenishing command is issued in response to, for example, detection of an image density, the powder pump 110 operates so as to replenish the developing apparatus 10 with a requested quantity of the toner.

Figure 4:
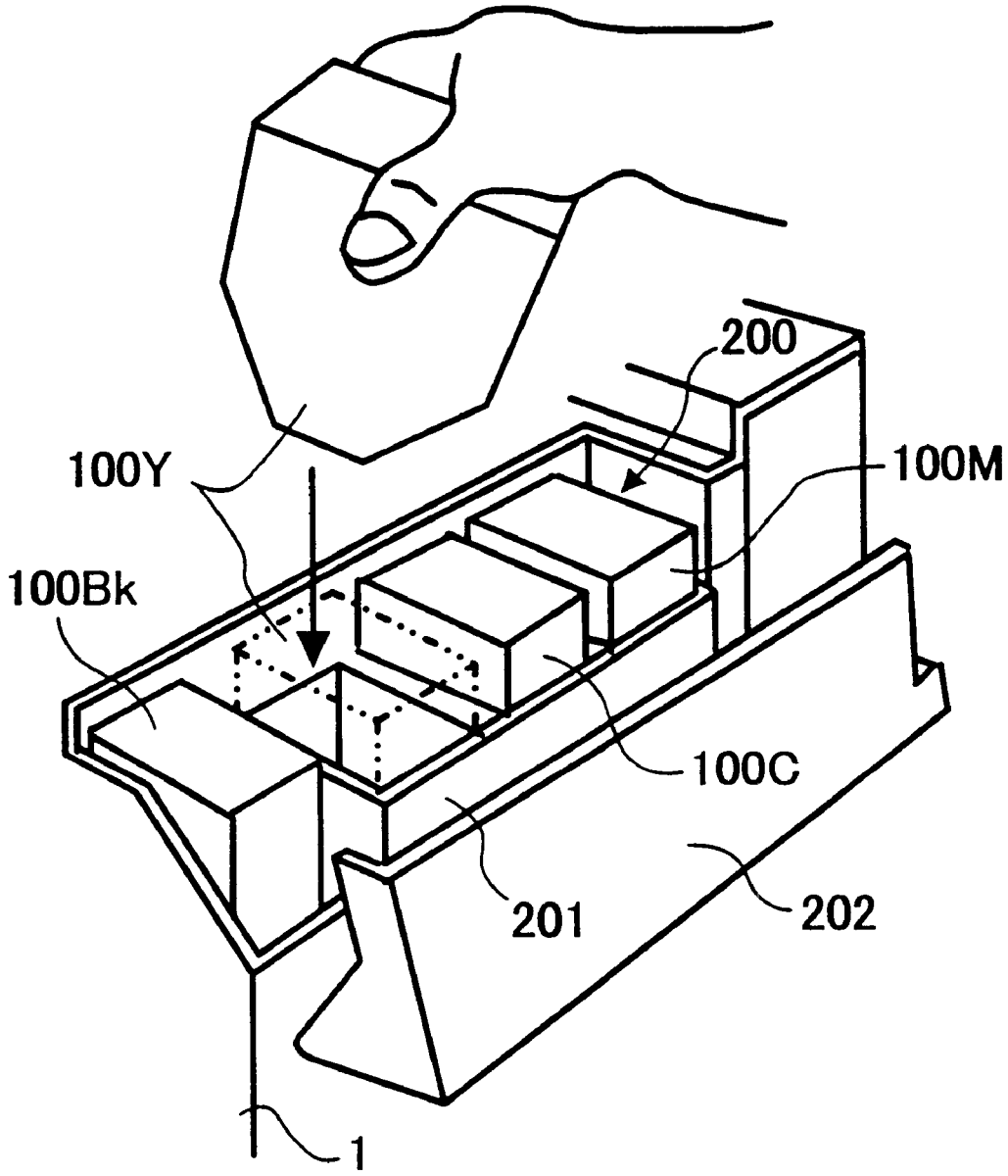
FIG. 4 is a perspective view of a toner container setting part of the color image forming apparatus of FIG. 1.

As shown in FIG. 4, a setting part 200 of the image forming apparatus main body 1, for setting the toner container 100 thereto, is configured as an individual unit separate from the developing apparatus 10. A receiving member 201, for receiving the toner container 100, is provided for the setting part 200. The nozzle 160, which has a circular cross-section and which is inserted into the toner bag 102, is provided in the receiving member 201. The toner container 100 is set in the setting part 200 of the image forming apparatus main body 1 from above, as will be described in more detail below. The nozzle 160, provided for the setting part 200, has a tip member 161 formed in a cross-sectional cone at the top of the nozzle 160. The tip member 161 is integrated with the nozzle 160 or fixed to the nozzle 160. The tip member 161 is followed by an air supply path 162 and a toner supply path 163. The inside of the nozzle 160 has a double-tube construction, and the toner supply path 163 is bent to the left, in FIG. 3, at the bottom end of the nozzle 160. The toner connecting mouth 165, provided at the end of the nozzle 160, is connected with the toner delivering tube 149. In addition, the air supply path 162 is bent to the right, in FIG. 3, at a higher position than the toner supply path 163, and is provided with an air connecting mouth 164.

In this embodiment, the air connecting mouth 164 is connected via an air delivering pipe 152 to an air pump 151, which is provided as an air supplying device. When the air pump 151 is operated, air is ejected from the pump 151, via the air delivering pipe 152 and the air supply path 162, into the toner container 100, from the lower side thereof. Then, the air, ejected into the toner container 100, agitates and fluidizes the toner, as the air passes through the toner.

In the above-described toner replenishing apparatus, even though the image forming units 4M, 4C, 4Y and 4Bk are separated from the toner containers 100M, 100C, 100Y and 100B, respectively, reliable toner replenishing is realized. Further, the toner containers 100M, 100C, 100Y and 100Bk can be arranged freely no matter what the positions of the image forming units 4M, 4C, 4Y and 4Bk, respectively. The image forming apparatuses, such as printers, are generally rectangular parallelepiped-shaped. Therefore, if the inclined transferring belt 20 is arranged in such printers, a space, which is substantially triangular in cross-section, is formed above and below the transferring belt 20. Therefore, in the embodiment, the toner containers 100M, 100C, 100Y and 100Bk are arranged in the triangular cross-section space, at an upper part of the main body 1, which is above the lower end part of the transferring belt 20.

In the color printer as described above, the triangular cross-section space, which is formed by the inclined transferring belt 20, can be effectively used by arranging the setting part 200 therein, thereby contributing to the reduction of the size of the apparatus. Further, in the setting part 200, because each toner container 100M, 100C, 100Y, and 100Bk is connected with each image forming unit 4M, 4C, 4Y, and 4Bk via a flexible tube, each toner container 100M, 100C, 100Y, and 100Bk can be arranged no matter what the arrangement order of the image forming unit 4M, 4C, 4Y, and 4Bk, i.e., despite the transferring order of toner images of different colors, thus increasing the freedom in the design. In the printer of the above embodiment, a discarded toner tank 93 is disposed in the triangular cross-section space, below the transferring belt 20.

Figure 5:
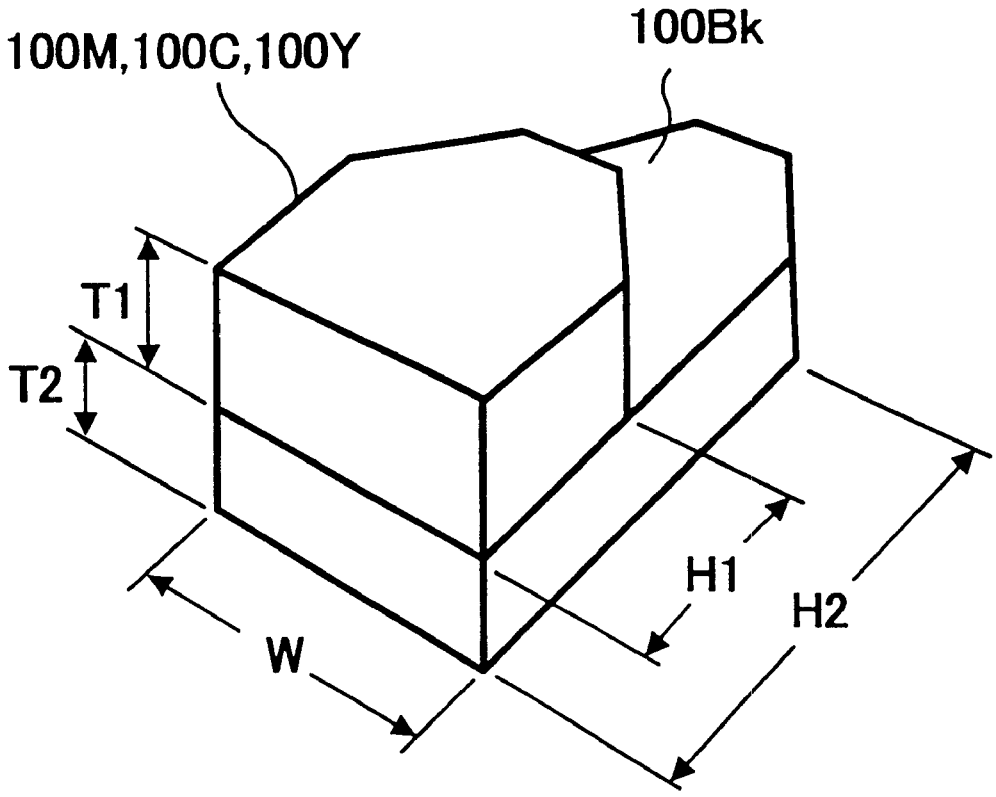
FIG. 5 is a perspective view illustrating the outer appearance of the toner container of FIG. 4.

The setting part 200 is arranged at an upper right-hand corner of the main body 1 when viewed from the front of the apparatus. As illustrated in FIG. 4, the toner containers 100M, 100C, 100Y and 100Bk are arranged so as to be parallel to each other in a line in the width-wise direction of the transferring belt 20, i.e., in the depth-wise direction of the main body 1, when viewed from the front of the apparatus. The toner containers 100M, 100C and 100Y are formed in the same size and shape. The toner container 100Bk has a larger capacity and therefore, is formed in a different size from the other toner containers 100M, 100C and 100Y. In the embodiment, the cases of the toner containers 100M, 100C and 100Y and the case of the toner container 100Bk, as shown in FIG. 5, have a same width W, for example, about 130 mm. However, the height H2 of the black toner container 100Bk is about twice of the height H1 of the toner containers 100M, 100C and 100Y, for example, about 270 mm. Further, the thickness T1 of the toner containers 100M, 100C and 100Y is thicker than the thickness T2 of the black toner container 100Bk. The thickness is set to a level wherein the user can attach and detach the container to and from the setting part 200 using only one hand. For example, the thickness T1 of the color toner containers 100M, 100C and 100Y is about 90 mm and the thickness T2 of the black toner container 100Bk is about 60 mm. The reason why the thickness T2 of the black toner container 100Bk is thinner than the other color toner containers is that, if the thickness T2 of the black toner container 100Bk is made to be approximately 90 mm, which is the same thickness as the other color toner containers, the black toner container 100Bk is fairly heavy, thereby causing the drawback that the black container 100Bk cannot be handled with only one hand.

Each of the toner containers 100M, 100C, 100Y and 100Bk is inserted into the setting part 200 from above so that the nozzle 160 is inserted into the toner bag 102 of each toner container 100M, 100C, 100Y, and 100Bk. The setting part 200 is configured such that when the toner containers 100M, 100C, 100Y and 100Bk are correctly set in the setting part 200, the upper surfaces of the toner containers 100M, 100C, 100C and 100Bk are in a straight line in the depthwise direction of the main body 1. That is, because the height H2 of the black toner container 100Bk is taller than the height H1 of the other containers 100M, 100C and 100Y, the receiving member 201 is made correspondingly deeper. Further, the setting part 200 is configured so that each of the toner containers 100M, 100C, 100Y, and 100Bk, set in the setting part 200 is exposed at a predetermined height when viewed from the front of the apparatus.

By configuring the setting part 200 as described above, when the toner containers 100M, 100C, 100Y and 100Bk are correctly set in the setting part 200, the upper surfaces thereof are at the same height. If any of the toner containers 100M, 100C, 100Y and 100Bk is incorrectly set in the setting part 200, i.e., the nozzle 160 is not inserted into the toner bag 102 of each toner container, the incorrectly set container protrudes. Therefore, the user can easily recognize, by sight, that inferior setting of the toner container has occurred. The 30 above-described exposed parts of the toner containers 100M, 100C, 100Y and 100Bk are covered by an open/close cover 202, which has a substantially dog-legged cross-section. The open/close cover 202 in this embodiment is opened and closed via a hinge (not shown) provided near a side plate of the main body 1 of the apparatus. The open/close cover 202 may be made detachable from the main body 1, or rotatable from the front side toward the rear side of the main body 1, with the hinge positioned at the rear side of the main body 1. Further, the setting part 200 can be configured such that the toner containers 100M, 100C, 100Y, and 100Bk are partly exposed without provision of the open/close cover 202.

The setting part 200 is configured so that the black toner container 100Bk, which has the largest capacity, is set at the front-most side of the main body 1. The black toner container 100Bk is longer than the other toner containers 100M, 100C, and 100Y in the setting direction, and thereby the attaching and detaching operation of the black toner container 100Bk is harder than for the other containers. Moreover, the black toner is consumed more and therefor the black toner container 100Bk is most frequently replaced. By arranging the black toner container 100Bk at the front side of the main body 1, where it is most convenient for handling the toner container, the inferior operability of the black toner container 100Bk is mitigated and thereby, the burden on the user in replacing the toner container is decreased. Each of the color toner containers 100M, 100C and 100Y can be arranged in any position, or can be arranged so that the distance from each toner container to the corresponding image forming unit is about the same as for other toner containers.

As described above, in order to make the upper surfaces of the toner containers 100M, 100C, 100Y and 100Bk of uniform height, the setting depth for the black toner container 100Bk, which has a height of about two times that of the other toner containers, is twice that for the other toner containers. Therefore, as illustrated in FIG. 1, the bottom surface of the black toner container 100Bk reaches the position where the optical writing apparatus 8 is located. However, while the optical writing apparatus 8 is arranged in a sheet conveying area, which is within the width of the transferring belt 20, the black toner container 100Bk is arranged in an area between the front door and the sheet conveying area. Accordingly, the size of the black toner container 100Bk is not restricted by the image forming part 3 and can be appropriately determined.

Figure 6:
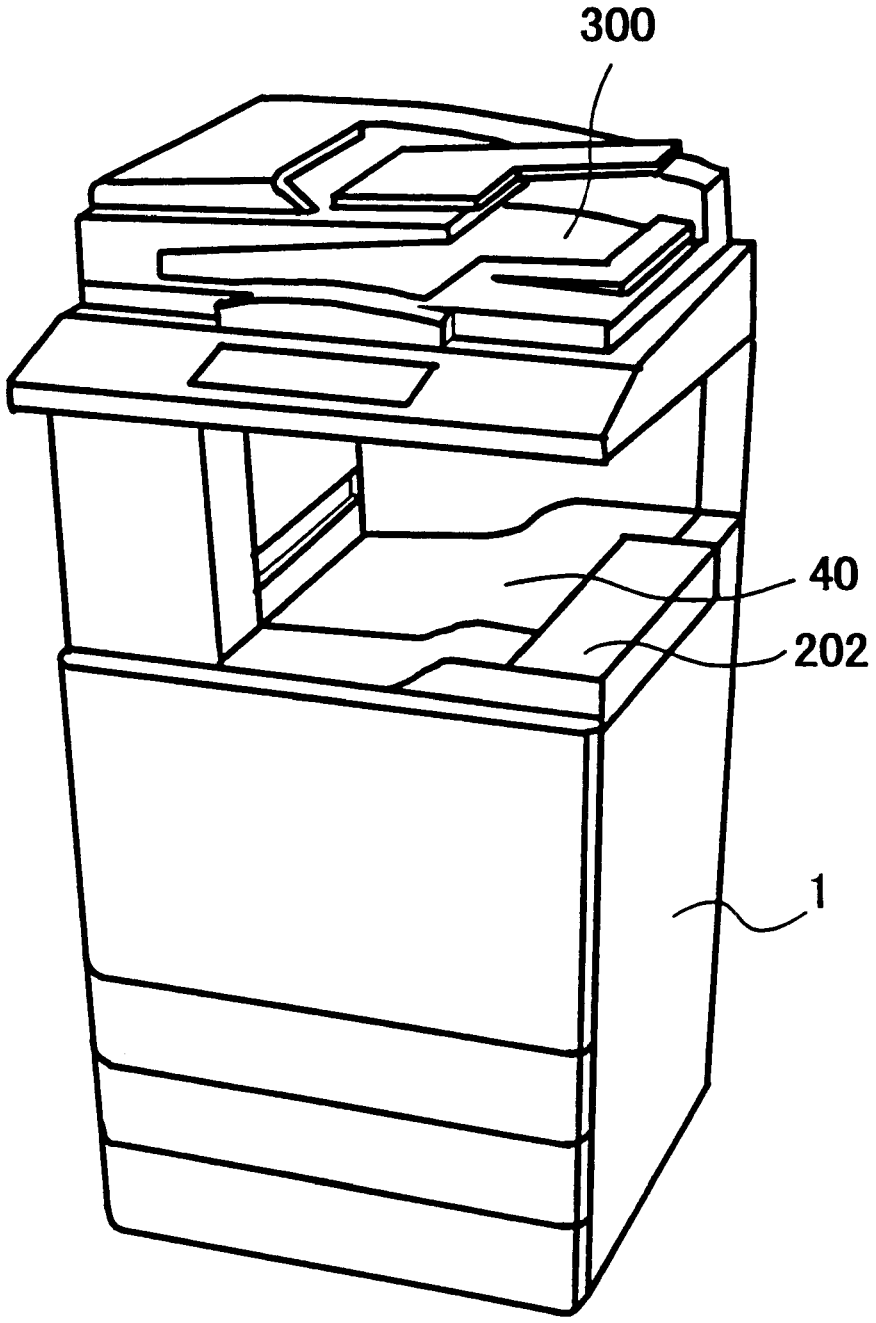
FIG. 6 is a schematic perspective view of a color image forming apparatus having a scanner, according to another preferred embodiment of the present invention.

The above-described printer can be configured to include a scanner 300 so as to perform copying and facsimile functions, arranged at an upper part of the main body 1, as illustrated in FIG. 6. The scanner 300 is located with an appropriate space from the upper surface of the main body 1, so that the printed sheet can be discharged onto the discharging tray 40. In the above-described configuration, because the toner containers 100M, 100C, 100C and 100Bk are set in the setting part 200 from above, the scanner 300 may hinder setting operations for the toner containers 100M, 100C, 100Y and 100Bk. In particular, the scanner 300 may obstruct the setting of the black toner container 100Bk, which is long in the setting direction.

Figure 7:
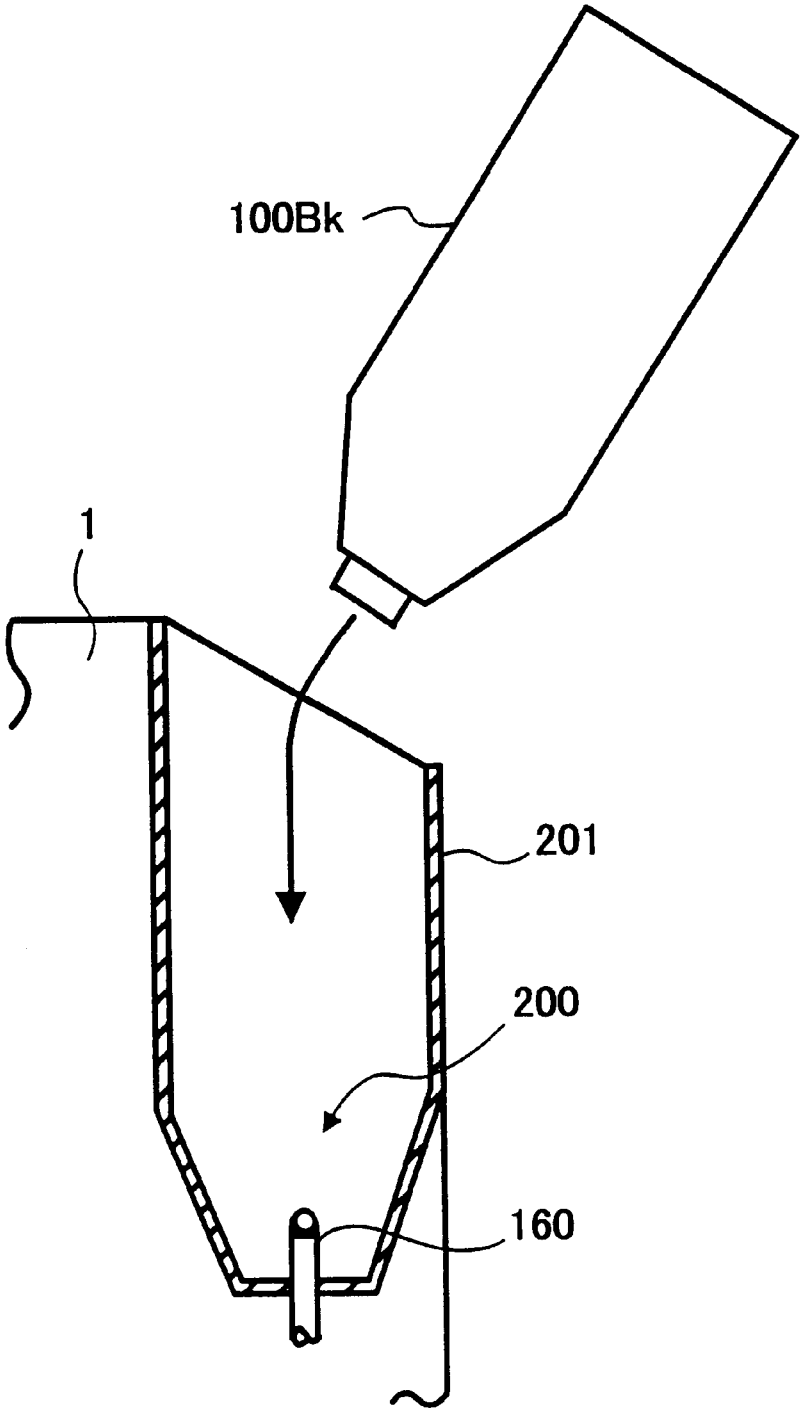
FIG. 7 is a cross-sectional view of a toner container setting part of the color image forming apparatus of FIG. 6.

However, as described above, the setting part 200 is arranged at the upper right hand side corner of the main body 1 when viewed from the front side of the printer, and further, the container receiving member 201 of the setting part 200 is diagonally opened at the inserting portion for the toner containers 100M, 100C, 100Y and 100Bk, as illustrated in FIG. 7. Accordingly, the toner containers 100M, 100C, 100Y and 100Bk can be inserted from right above and drawn out in the upper right-hand direction. Thus, by configuring the setting part 200 as described above, even when the scanner 300 is provided, attaching and detaching of the toner containers 100M, 100C, 100Y and 100Bk is prevented from being hindered.

The above description of the preferred embodiment has been made with respect to a color printer of a tandem method. However, the present invention can be applied to color printers of any of the transfer drum method, the intermediate transfer method, and the image-on-image method. Further, the printer, illustrated in FIG. 6, is configured such that the scanner 300 is supported by the main body 1. However, the present invention can be applied to printers in which the scanner 300 is separate from the main body 1 of the printer and is supported by a separate rack or similar.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A color image forming apparatus, comprising:

a main body; and a toner container setting part configured to set a plurality of toner containers individually therein, each of said plurality of toner containers containing a toner of a different color, and said toner container setting part including a receiving member configured to receive said plurality of toner containers inserted therein, wherein said plurality of toner containers inserted in said receiving member are partially exposed, and wherein said receiving member differs in length in a direction said plurality of toner containers are inserted therein according to a length of a corresponding toner container of said plurality of toner containers.

2. The color image forming apparatus of claim 1, wherein said receiving member is opened at an upper part thereof, so that said plurality of toner containers can be inserted into and drawn out of said receiving member from above, and wherein upper parts of said plurality of toner containers inserted in the receiving member are exposed.

3. The color image forming apparatus of claim 1, wherein said plurality of toner containers, set in said toner container setting part, are arranged parallel to each other in a straight line.

4. The color image forming apparatus of claim 1, further comprising:

a transferring belt to convey a transfer sheet; and a plurality of image forming units arranged along said transferring belt, wherein said plurality of toner containers, set in said toner container setting part, are arranged in a direction orthogonal to a moving direction of said transferring belt.

5. The color image forming apparatus of claim 4, wherein said moving direction of said transferring belt is in a width-wise direction of said main body, and wherein said plurality of toner containers, set in said toner container setting part, are arranged in a depth-wise direction of said main body.

6. The color image forming apparatus of claim 5, wherein said plurality of toner containers, set in said toner container setting part, are arranged at an upper part of said main body substantially along an edge of said main body.

7. The color image forming apparatus of claim 4, wherein said transferring belt is slanted so that a first end thereof is lower than a second end thereof, and wherein said toner container setting part is provided above said first end of said transferring belt, which is lower than said second end.

8. The color image forming apparatus of claim 7, wherein a toner container of said plurality of toner containers, which is set at a front side in said toner container setting part in a depth-wise direction of said main body, is located outside of an area in a width-wise direction of said main body, where said transferring belt is located.

9. The color image forming apparatus of claim 7, wherein said plurality of toner containers are arranged in said toner container setting part in an order not corresponding to an order of said plurality of image forming units arranged along said transferring belt.

10. The color image forming apparatus of claim 1, wherein upper surfaces of said plurality of toner containers inserted into said receiving member are substantially at a uniform level.

11. The color image forming apparatus of claim 1, wherein a toner container of said plurality of toner containers, which has a largest toner containing capacity among said plurality of toner containers, is set at a front side in said toner container setting part in a depth-wise direction of said main body.

12. The color image forming apparatus of claim 1, wherein a toner container of said plurality of toner containers, which has a longest length in a direction said plurality of containers are inserted into said receiving member, is set at a front side in said toner container setting part in a depth-wise direction of said main body.

13. The color image forming apparatus of claim 1, wherein a toner container of said plurality of toner containers, which is most frequently replaced, is set at a front side in said toner container setting part in a depth-wise direction of said main body.

14. The color image forming apparatus of claim 1, wherein a toner container of said plurality of toner containers, which contains black toner, is set at a front side in said toner container setting part in a depth-wise direction of said main body.

15. The color image forming apparatus of claim 1, further comprising a cover configured to cover partially exposed portions of said plurality of toner containers inserted in said receiving member, said cover being provided on said main body and configured to open and close.

16. A set of a plurality of toner containers for setting in a setting part of a color image forming apparatus, the setting part being configured to set a plurality of toner containers individually, the setting part including a receiving member to receive the plurality of toner containers inserted therein, and the setting part being further configured so that the plurality of toner containers inserted into the receiving member are partially exposed, each of the toner containers comprising:

a deformable toner bag for containing toner; and a case to accommodate said deformable toner bag, wherein said case of a toner container of the plurality of toner containers, which is set at a front side in the setting part in a depth-wise direction of the color image forming apparatus, is longer than said case of other toner containers of the plurality of toner containers in a direction the plurality of toner containers are inserted into the setting part of the color image forming apparatus.

17. The set of the plurality of toner containers of claim 16, wherein a width of said case of the toner container of the plurality of toner containers, which is set at the front side in the setting part in the depth-wise direction of the color image forming apparatus, is greater than a width of the other toner containers of the plurality of toner containers.

18. A toner replenishing apparatus for replenishing a developing device with a toner in a color image forming apparatus, said toner replenishing apparatus comprising:

a setting part configured to set a plurality of toner containers individually therein, each of said toner containers containing said toner of a different color, and said setting part including a receiving member configured to receive said plurality of toner containers inserted therein; and a toner conveying device to convey said toner contained, in each of said plurality of toner containers set in said setting part, to the developing device, wherein said plurality of toner containers, inserted into said receiving member, are partially exposed, and wherein said receiving member differs in length in a direction said plurality of toner containers are inserted therein, according to a length of a corresponding toner container of said plurality of toner containers.

19. The toner replenishing apparatus of claim 18, wherein said receiving member is opened at an upper part thereof, so that said plurality of toner containers can be inserted therein and drawn there out from above, and wherein upper parts, of said plurality of toner containers inserted in said receiving member, are exposed.

20. The toner replenishing apparatus of claim 18, wherein said plurality of toner containers set in said setting part are arranged parallel to each other in a straight line.

21. The toner replenishing apparatus of claim 18, wherein the color image forming apparatus includes a transferring belt to convey a transfer sheet and a plurality of image forming units arranged along the transferring belt, and wherein said plurality of toner containers, set in said setting part, are arranged in a direction orthogonal to a moving direction of the transferring belt.

22. The toner replenishing apparatus of claim 21, wherein the moving direction of the transferring belt is in a width-wise direction of the color image forming apparatus, and wherein said plurality of toner containers, set in said setting part, are arranged in a depth-wise direction of the color image forming apparatus.

23. The toner replenishing apparatus of claim 22, wherein said plurality of toner containers, set in said setting part, are arranged at an upper part of the color image forming apparatus substantially along an edge of the color image forming apparatus.

24. The toner replenishing apparatus of claim 21, wherein the transferring belt of the color image forming apparatus is slanted so that a first end thereof is lower than a second end thereof, and wherein said setting part is provided above the first end of the transferring belt, which is lower than the second end.

25. The toner replenishing apparatus of claim 24, wherein a toner container of said plurality of toner containers, which is set at a front side in said setting part in a depth-wise direction of the color image forming apparatus, is located outside of an area in a width-wise direction of the color image forming apparatus where the transferring belt is located.

26. The toner replenishing apparatus of claim 24, wherein said plurality of toner containers are arranged in said setting part in an order not corresponding to an order of the plurality of image forming units arranged along the transferring belt.

27. The toner replenishing apparatus of claim 18, wherein upper surfaces, of said plurality of toner containers inserted into said receiving member, are substantially at a uniform level.

28. The toner replenishing apparatus of claim 18, wherein a toner container of said plurality of toner containers, which has a largest toner containing capacity among said plurality of toner containers, is set at a front side in said setting part in a depth-wise direction of the color image forming apparatus.

29. The toner replenishing apparatus of claim 18, wherein a toner container of said plurality of toner containers, which has a longest length in a direction said plurality of containers are inserted into said receiving member, is set at a front side in said setting part in a depth-wise direction of the color image forming apparatus.

30. The toner replenishing apparatus of claim 18, wherein a toner container of said plurality of toner containers, which is most frequently replaced, is set at a front side in said setting part in a depth-wise direction of the color image forming apparatus.

31. The toner replenishing apparatus of claim 18, wherein a toner container of said plurality of toner containers, which contains black toner, is set at a front side in said setting part in a depth-wise direction of the color image forming apparatus.

32. The toner replenishing apparatus of claim 18, further comprising a cover configured to cover partially exposed portions of said plurality of toner containers inserted in said receiving member, said cover being provided to the color image forming apparatus and configured to open and close.

33. A color image forming apparatus, comprising:

a main body; and setting means for setting a plurality of toner containers individually, each of said plurality of toner containers containing a toner of a different color, said setting means including receiving means for receiving said plurality of toner containers inserted therein, wherein said plurality of toner containers inserted in said receiving means are partially exposed, and wherein said receiving means differs in length in a direction said plurality of toner containers are inserted therein, according to a length of a corresponding toner container of said plurality of toner containers.

34. A toner replenishing apparatus to replenish a developing device with a toner in a color image forming apparatus, said toner replenishing apparatus comprising:

setting means for setting a plurality of toner containers individually therein, each of said plurality of toner containers containing said toner of a different color, said setting means including receiving means for receiving said plurality of toner containers inserted therein; and conveying means for conveying said toner contained in each of said plurality of toner containers, set in said setting means, to the developing device, wherein said plurality of toner containers, inserted into said receiving means, are partially exposed, and wherein said receiving means differs in length in a direction said plurality of toner containers are inserted therein, according to a length of a corresponding toner container of said plurality of toner containers.

* * * * *